US008376313B2

(12) United States Patent
Burke et al.

(10) Patent No.: US 8,376,313 B2
(45) Date of Patent: Feb. 19, 2013

(54) CAPACITIVE TOUCH SENSOR

(75) Inventors: David M Burke, Taylor, MI (US); Fabio Pandini, Pavia (IT)

(73) Assignee: Masco Corporation of Indiana, Indianapolis, IN (US)

( * ) Notice: Subject to any disclaimer, the term of this patent is extended or adjusted under 35 U.S.C. 154(b) by 529 days.

(21) Appl. No.: 12/523,013

(22) PCT Filed: Mar. 24, 2008

(86) PCT No.: PCT/US2008/003829

§ 371 (c)(1),
(2), (4) Date: Jul. 13, 2009

(87) PCT Pub. No.: WO2008/118402

PCT Pub. Date: Oct. 2, 2008

(65) Prior Publication Data

US 2010/0044604 A1 Feb. 25, 2010

Related U.S. Application Data

(60) Provisional application No. 60/920,420, filed on Mar. 28, 2007.

(51) Int. Cl.
*F16K 31/02* (2006.01)

(52) U.S. Cl. ..... 251/129.04; 4/623; 327/517

(58) Field of Classification Search ..... 251/129.03–129.06; 4/623; 327/517
See application file for complete search history.

(56) References Cited

U.S. PATENT DOCUMENTS

| | | | | |
|---|---|---|---|---|
| 2,991,481 | A | 7/1961 | Book | |
| 3,081,594 | A | 3/1963 | Atkins et al. | |
| 3,151,340 | A | 10/1964 | Teshima | |
| 3,254,313 | A | 5/1966 | Atkins et al. | |
| 3,314,081 | A | 4/1967 | Atkins et al. | |
| 3,333,160 | A | 7/1967 | Gorski | |
| 3,406,941 | A | 10/1968 | Ichimori et al. | |
| 3,588,038 | A | 6/1971 | Tanaka | |
| 3,651,989 | A | 3/1972 | Westrich | |
| 3,685,541 | A | 8/1972 | Braucksick et al. | |
| 3,705,574 | A | 12/1972 | Duncan | |
| 3,765,455 | A | 10/1973 | Countryman | |
| 3,799,171 | A | 3/1974 | Patel | |
| 3,987,819 | A | 10/1976 | Scheuermann | |
| 4,004,234 | A * | 1/1977 | Juvinall | 307/652 |
| 4,185,336 | A | 1/1980 | Young | |

(Continued)

FOREIGN PATENT DOCUMENTS

| | | |
|---|---|---|
| CA | 2492226 A1 | 7/2005 |
| DE | 3339849 | 5/1985 |

(Continued)

OTHER PUBLICATIONS

Camacho et al., Freescale Semiconductor, "Touch Pad System Using MC34940/MC33794 E-Field Sensors," Feb. 2006, 52 pgs.

(Continued)

*Primary Examiner* — John Fristoe, Jr.
*Assistant Examiner* — Matthew W Jellett
(74) *Attorney, Agent, or Firm* — Faegre Baker Daniels LLP

(57) ABSTRACT

A fluid delivery apparatus comprises a spout, a fluid supply conduit supported by the spout, a valve assembly to supply fluid through the fluid supply conduit, and a capacitive touch sensor. The capacitive touch sensor is coupled to a controller. The controller is also coupled to the valve assembly. The controller is configured to detect a user touching the sensor and to control flow of fluid through the fluid supply conduit.

39 Claims, 3 Drawing Sheets

U.S. PATENT DOCUMENTS

| | | | |
|---|---|---|---|
| 4,201,518 | A | 5/1980 | Stevenson |
| 4,290,052 | A | 9/1981 | Eichelberger et al. |
| 4,295,132 | A | 10/1981 | Burney et al. |
| 4,331,292 | A | 5/1982 | Zimmer |
| 4,337,388 | A | 6/1982 | July |
| 4,359,186 | A | 11/1982 | Kiendl |
| 4,406,313 | A | 9/1983 | Bennett et al. |
| 4,407,444 | A | 10/1983 | Knebel et al. |
| 4,409,694 | A | 10/1983 | Barrett et al. |
| 4,410,791 | A | 10/1983 | Eastep |
| 4,420,811 | A | 12/1983 | Tarnay et al. |
| 4,421,269 | A | 12/1983 | Ts'ao |
| 4,424,767 | A | 1/1984 | Wicke et al. |
| 4,429,422 | A | 2/1984 | Wareham |
| 4,436,983 | A | 3/1984 | Solobay |
| 4,439,669 | A | 3/1984 | Ryffel |
| 4,450,829 | A | 5/1984 | Morita et al. |
| 4,459,465 | A | 7/1984 | Knight |
| 4,503,575 | A | 3/1985 | Knoop et al. |
| 4,537,348 | A | 8/1985 | Gossi |
| 4,541,562 | A | 9/1985 | Zukausky |
| 4,554,688 | A | 11/1985 | Puccerella |
| 4,563,780 | A | 1/1986 | Pollack |
| 4,567,350 | A | 1/1986 | Todd Jr. |
| 4,581,707 | A | 4/1986 | Millar |
| 4,584,463 | A | 4/1986 | Klages et al. |
| 4,604,515 | A | 8/1986 | Davidson |
| 4,606,325 | A | 8/1986 | Lujan |
| 4,611,757 | A | 9/1986 | Saether |
| 4,628,902 | A | 12/1986 | Comber |
| 4,638,147 | A | 1/1987 | Dytch et al. |
| 4,674,678 | A | 6/1987 | Knebel et al. |
| 4,680,446 | A | 7/1987 | Post |
| 4,682,581 | A | 7/1987 | Laing et al. |
| 4,682,728 | A | 7/1987 | Oudenhoven et al. |
| 4,688,277 | A | 8/1987 | Kakinoki et al. |
| 4,700,884 | A | 10/1987 | Barrett et al. |
| 4,700,885 | A | 10/1987 | Knebel |
| 4,709,728 | A | 12/1987 | Ying-Chung |
| 4,713,525 | A | 12/1987 | Eastep |
| 4,716,605 | A | 1/1988 | Shepherd et al. |
| 4,735,357 | A | 4/1988 | Gregory et al. |
| 4,738,280 | A | 4/1988 | Oberholtzer |
| 4,742,456 | A | 5/1988 | Kamena |
| 4,750,472 | A | 6/1988 | Fazekas |
| 4,753,265 | A | 6/1988 | Barrett et al. |
| 4,756,030 | A | 7/1988 | Juliver |
| 4,757,943 | A | 7/1988 | Sperling et al. |
| 4,761,839 | A | 8/1988 | Ganaway |
| 4,762,273 | A | 8/1988 | Gregory et al. |
| 4,768,705 | A | 9/1988 | Tsutsui et al. |
| 4,786,782 | A | 11/1988 | Takai et al. |
| 4,798,224 | A | 1/1989 | Haws |
| 4,808,793 | A | 2/1989 | Hurko |
| 4,832,259 | A | 5/1989 | Vandermeyden |
| 4,845,316 | A | 7/1989 | Kaercher |
| 4,854,498 | A | 8/1989 | Stayton |
| 4,869,287 | A | 9/1989 | Pepper et al. |
| 4,869,427 | A | 9/1989 | Kawamoto et al. |
| 4,870,986 | A | 10/1989 | Barrett et al. |
| 4,872,485 | A | 10/1989 | Laverty |
| 4,875,623 | A | 10/1989 | Garris |
| 4,893,653 | A | 1/1990 | Ferrigno |
| 4,896,658 | A | 1/1990 | Yonekubo et al. |
| 4,901,915 | A | 2/1990 | Sakakibara |
| 4,909,435 | A | 3/1990 | Kidouchi et al. |
| 4,914,758 | A | 4/1990 | Shaw |
| 4,916,613 | A | 4/1990 | Lange et al. |
| 4,917,142 | A | 4/1990 | Laing et al. |
| 4,921,211 | A | 5/1990 | Novak et al. |
| 4,923,116 | A | 5/1990 | Homan |
| 4,930,551 | A | 6/1990 | Haws |
| 4,936,289 | A | 6/1990 | Peterson |
| 4,941,608 | A | 7/1990 | Shimizu et al. |
| 4,945,942 | A | 8/1990 | Lund |
| 4,945,943 | A | 8/1990 | Cogger |
| 4,955,535 | A | 9/1990 | Tsutsui et al. |
| 4,965,894 | A | 10/1990 | Baus |
| 4,967,794 | A | 11/1990 | Tsutsui et al. |
| 4,969,598 | A | 11/1990 | Garris |
| 4,970,373 | A | 11/1990 | Lutz et al. |
| 4,971,106 | A | 11/1990 | Tsutsui et al. |
| 4,981,158 | A | 1/1991 | Brondolino et al. |
| 4,985,944 | A | 1/1991 | Shaw |
| 4,995,585 | A | 2/1991 | Gruber et al. |
| 4,998,673 | A | 3/1991 | Pilolla |
| 5,009,572 | A | 4/1991 | Imhoff et al. |
| 5,012,124 | A | 4/1991 | Hollaway |
| 5,020,127 | A | 5/1991 | Eddas et al. |
| 5,033,508 | A | 7/1991 | Laverty |
| 5,033,715 | A | 7/1991 | Chiang |
| 5,040,106 | A | 8/1991 | Maag |
| 5,042,524 | A | 8/1991 | Lund |
| 5,056,712 | A | 10/1991 | Enck |
| 5,057,214 | A | 10/1991 | Morris |
| 5,058,804 | A | 10/1991 | Yonekubo et al. |
| 5,063,955 | A | 11/1991 | Sakakibara |
| 5,073,991 | A | 12/1991 | Marty |
| 5,074,520 | A | 12/1991 | Lee et al. |
| 5,086,526 | A | 2/1992 | Van Marcke |
| 5,092,560 | A | 3/1992 | Chen |
| 5,095,945 | A | 3/1992 | Jensen |
| 5,105,846 | A | 4/1992 | Britt |
| 5,124,934 | A | 6/1992 | Kawamoto et al. |
| 5,125,433 | A | 6/1992 | DeMoss et al. |
| 5,129,034 | A | 7/1992 | Sydenstricker |
| 5,133,089 | A | 7/1992 | Tsutsui et al. |
| 5,139,044 | A | 8/1992 | Otten et al. |
| 5,143,049 | A | 9/1992 | Laing et al. |
| 5,148,824 | A | 9/1992 | Wilson et al. |
| 5,170,361 | A | 12/1992 | Reed |
| 5,170,514 | A | 12/1992 | Weigert |
| 5,170,816 | A | 12/1992 | Schnieders |
| 5,170,944 | A | 12/1992 | Shirai |
| 5,174,495 | A | 12/1992 | Eichholz et al. |
| 5,175,892 | A | 1/1993 | Shaw |
| 5,183,029 | A | 2/1993 | Ranger |
| 5,184,642 | A | 2/1993 | Powell |
| 5,187,816 | A | 2/1993 | Chiou |
| 5,202,666 | A | 4/1993 | Knippscheer |
| 5,205,318 | A | 4/1993 | Massaro et al. |
| 5,206,963 | A | 5/1993 | Wiens |
| 5,217,035 | A | 6/1993 | Van Marcke |
| 5,224,509 | A | 7/1993 | Tanaka et al. |
| 5,224,685 | A | 7/1993 | Chiang et al. |
| 5,243,717 | A | 9/1993 | Yasuo |
| D340,279 | S | 10/1993 | Mattis |
| 5,257,341 | A | 10/1993 | Austin et al. |
| 5,261,443 | A | 11/1993 | Walsh |
| 5,262,621 | A | 11/1993 | Hu et al. |
| 5,265,318 | A | 11/1993 | Shero |
| 5,277,219 | A | 1/1994 | Lund |
| 5,281,808 | A | 1/1994 | Kunkel |
| 5,287,570 | A | 2/1994 | Peterson et al. |
| 5,309,940 | A | 5/1994 | Delabie et al. |
| 5,315,719 | A | 5/1994 | Tsutsui et al. |
| 5,322,086 | A | 6/1994 | Sullivan |
| 5,323,803 | A | 6/1994 | Blumenauer |
| 5,325,822 | A | 7/1994 | Fernandez |
| 5,334,819 | A | 8/1994 | Lin |
| 5,341,839 | A | 8/1994 | Kobayashi et al. |
| 5,351,347 | A | 10/1994 | Kunkel |
| 5,351,712 | A | 10/1994 | Houlihan |
| 5,358,177 | A | 10/1994 | Cashmore |
| 5,361,215 | A | 11/1994 | Tompkins et al. |
| 5,362,026 | A | 11/1994 | Kobayashi et al. |
| 5,385,168 | A | 1/1995 | Lund |
| 5,397,099 | A | 3/1995 | Pilolla |
| 5,400,961 | A | 3/1995 | Tsutsui et al. |
| 5,408,578 | A | 4/1995 | Bolivar |
| 5,419,930 | A | 5/1995 | Schucker |
| 5,429,272 | A | 7/1995 | Luigi |
| 5,437,003 | A | 7/1995 | Blanco |
| RE35,018 | E | 8/1995 | Homan |
| 5,438,642 | A | 8/1995 | Posen |
| 5,467,967 | A | 11/1995 | Gillooly |
| 5,479,558 | A | 12/1995 | White et al. |

5,482,250 A 1/1996 Kodaira
5,504,306 A 4/1996 Russell et al.
5,504,950 A 4/1996 Natalizia et al.
5,511,579 A 4/1996 Price
5,511,723 A 4/1996 Eki et al.
5,540,555 A 7/1996 Corso et al.
5,549,273 A 8/1996 Aharon
5,550,753 A 8/1996 Tompkins et al.
5,551,637 A 9/1996 Lo
5,555,912 A 9/1996 Saadi et al.
5,564,462 A 10/1996 Storch
5,566,702 A 10/1996 Philipp
5,570,869 A 11/1996 Diaz et al.
5,572,205 A * 11/1996 Caldwell et al. ..... 341/33
5,572,985 A 11/1996 Benham
5,577,660 A 11/1996 Hansen
5,584,316 A 12/1996 Lund
5,586,572 A 12/1996 Lund
5,588,636 A 12/1996 Eichholz et al.
5,595,216 A 1/1997 Pilolla
5,595,342 A 1/1997 McNair et al.
5,603,344 A 2/1997 Hall
5,609,370 A 3/1997 Szabo et al.
5,610,589 A 3/1997 Evans et al.
5,622,203 A 4/1997 Givler et al.
5,623,990 A 4/1997 Pirkle
5,627,375 A 5/1997 Hsieh
5,650,597 A 7/1997 Redmayne
5,651,384 A 7/1997 Rudrich
5,655,749 A 8/1997 Mauerhofer
5,682,032 A 10/1997 Philipp
5,694,653 A 12/1997 Harald
5,729,422 A 3/1998 Henke
5,730,165 A 3/1998 Philipp
5,735,291 A 4/1998 Kaonohi
5,743,511 A 4/1998 Eichholz et al.
5,755,262 A 5/1998 Pilolla
5,758,688 A 6/1998 Hamanaka et al.
5,758,690 A 6/1998 Humpert et al.
5,769,120 A 6/1998 Laverty et al.
5,771,501 A 6/1998 Shaw
5,775,372 A 7/1998 Houlihan
5,784,531 A 7/1998 Mann et al.
5,790,024 A 8/1998 Ripingill et al.
5,796,183 A * 8/1998 Hourmand ..... 307/116
5,812,059 A 9/1998 Shaw et al.
5,813,655 A 9/1998 Pinchott et al.
5,819,366 A 10/1998 Edin
5,829,467 A 11/1998 Spicher
5,829,475 A 11/1998 Acker
5,845,844 A 12/1998 Zosimodis
5,855,356 A 1/1999 Fait
5,857,717 A 1/1999 Caffrey
5,868,311 A 2/1999 Cretu-Petra
5,872,891 A 2/1999 Son
5,893,387 A 4/1999 Paterson et al.
5,915,417 A 6/1999 Diaz et al.
5,918,855 A 7/1999 Hamanaka et al.
5,920,309 A * 7/1999 Bisset et al. ..... 345/173
5,934,325 A 8/1999 Brattoli et al.
5,941,275 A 8/1999 Laing
5,941,504 A 8/1999 Toma et al.
5,943,713 A 8/1999 Paterson et al.
5,944,221 A 8/1999 Laing et al.
5,961,095 A 10/1999 Schrott
5,963,624 A 10/1999 Pope
5,966,753 A 10/1999 Gauthier et al.
5,973,417 A 10/1999 Goetz et al.
5,979,776 A 11/1999 Williams
5,983,922 A 11/1999 Laing et al.
5,988,593 A 11/1999 Rice
6,000,170 A 12/1999 Davis
6,003,170 A 12/1999 Humpert et al.
6,003,182 A 12/1999 Song
6,006,784 A 12/1999 Tsutsui et al.
6,019,130 A 2/2000 Rump
6,026,844 A 2/2000 Laing et al.
6,029,094 A 2/2000 Diffut
6,032,616 A 3/2000 Jones
6,042,885 A 3/2000 Woollard et al.
6,059,192 A 5/2000 Zosimadis
6,061,499 A 5/2000 Hlebovy
6,075,454 A 6/2000 Yamasaki
6,082,407 A 7/2000 Paterson et al.
6,101,452 A 8/2000 Krall et al.
6,125,482 A 10/2000 Foster
6,132,085 A 10/2000 Bergeron
6,167,845 B1 1/2001 Decker, Sr.
6,175,689 B1 1/2001 Blanco, Jr.
6,182,683 B1 2/2001 Sisk
6,192,192 B1 2/2001 Illy et al.
6,195,588 B1 2/2001 Gauthier et al.
6,202,980 B1 3/2001 Vincent et al.
6,220,297 B1 4/2001 Marty et al.
6,227,235 B1 5/2001 Laing et al.
6,240,250 B1 5/2001 Blanco, Jr.
6,250,558 B1 6/2001 Dogre Cuevas
6,250,601 B1 6/2001 Kolar et al.
6,273,394 B1 8/2001 Vincent et al.
6,283,139 B1 9/2001 Symonds et al.
6,286,764 B1 9/2001 Garvey et al.
6,288,707 B1 9/2001 Philipp
6,290,139 B1 9/2001 Kolze
6,294,786 B1 9/2001 Marcichow et al.
6,315,208 B1 11/2001 Doyle
6,317,717 B1 11/2001 Lindsey et al.
6,321,785 B1 11/2001 Bergmann
6,337,635 B1 1/2002 Ericksen et al.
6,340,032 B1 1/2002 Zosimadis
6,341,389 B2 1/2002 Philipps-Liebich et al.
6,351,603 B2 2/2002 Waithe et al.
6,363,549 B2 4/2002 Humpert et al.
6,373,265 B1 4/2002 Morimoto et al.
6,377,009 B1 4/2002 Philipp
6,381,770 B1 5/2002 Raisch
6,389,226 B1 5/2002 Neale et al.
6,438,770 B1 8/2002 Hed et al.
6,445,306 B1 9/2002 Trovato et al.
6,446,875 B1 9/2002 Brooks et al.
6,452,514 B1 9/2002 Philipp
RE37,888 E 10/2002 Cretu-Petra
6,457,355 B1 10/2002 Philipp
6,466,036 B1 10/2002 Philipp
6,473,917 B1 11/2002 Mateina
6,474,951 B2 11/2002 Stephan et al.
6,513,787 B1 2/2003 Jeromson et al.
6,522,078 B1 2/2003 Okamoto et al.
6,535,134 B2 3/2003 Lang et al.
6,535,200 B2 3/2003 Philipp
6,536,464 B1 3/2003 Lum et al.
6,549,816 B2 4/2003 Gauthier et al.
6,568,655 B2 * 5/2003 Paese et al. ..... 251/129.04
6,574,426 B1 6/2003 Blanco, Jr.
6,588,377 B1 7/2003 Leary et al.
6,588,453 B2 7/2003 Marty et al.
6,612,267 B1 9/2003 West
6,619,320 B2 9/2003 Parsons
6,622,930 B2 9/2003 Laing et al.
6,629,645 B2 10/2003 Mountford et al.
6,639,209 B1 10/2003 Patterson et al.
6,644,333 B2 11/2003 Gloodt
6,659,048 B1 12/2003 DeSantis et al.
6,676,024 B1 1/2004 McNerney et al.
6,684,822 B1 2/2004 Lieggi
6,691,338 B2 2/2004 Zieger
6,705,534 B1 3/2004 Mueller
6,707,030 B1 3/2004 Watson
6,734,685 B2 5/2004 Rudrich
6,738,996 B1 5/2004 Malek et al.
6,757,921 B2 7/2004 Esche
6,768,103 B2 7/2004 Watson
6,770,869 B2 8/2004 Patterson et al.
6,779,552 B1 8/2004 Coffman
6,838,887 B2 1/2005 Denen et al.
6,845,526 B2 1/2005 Malek et al.
6,877,172 B2 4/2005 Malek et al.
6,892,952 B2 5/2005 Chang et al.
6,895,985 B2 5/2005 Popper et al.

| | | | | |
|---|---|---|---|---|
| 6,913,203 | B2 | 7/2005 | DeLangis | |
| 6,955,333 | B2 | 10/2005 | Patterson et al. | |
| 6,956,498 | B1 | 10/2005 | Gauthier et al. | |
| 6,962,162 | B2 | 11/2005 | Acker | |
| 6,962,168 | B2 | 11/2005 | McDaniel et al. | |
| 6,964,404 | B2 | 11/2005 | Patterson et al. | |
| 6,964,405 | B2 | 11/2005 | Marcichow et al. | |
| 6,968,860 | B1 | 11/2005 | Haenlein et al. | |
| 6,980,084 | B1 * | 12/2005 | Yones | 340/10.34 |
| 6,993,607 | B2 | 1/2006 | Philipp | |
| 6,995,670 | B2 | 2/2006 | Wadlow et al. | |
| 6,998,545 | B2 | 2/2006 | Harkcom et al. | |
| 7,006,078 | B2 | 2/2006 | Kim | |
| 7,014,166 | B1 | 3/2006 | Wang | |
| 7,015,704 | B1 | 3/2006 | Lang | |
| 7,025,077 | B2 | 4/2006 | Vogel | |
| 7,030,860 | B1 | 4/2006 | Hsu et al. | |
| 7,069,357 | B2 | 6/2006 | Marx et al. | |
| 7,069,941 | B2 | 7/2006 | Parsons et al. | |
| 7,083,156 | B2 | 8/2006 | Jost et al. | |
| 7,096,517 | B2 | 8/2006 | Gubeli et al. | |
| 7,099,649 | B2 | 8/2006 | Patterson et al. | |
| D528,991 | S | 9/2006 | Katsuyama | |
| 7,102,366 | B2 | 9/2006 | Denen et al. | |
| 7,107,631 | B2 | 9/2006 | Lang et al. | |
| 7,150,293 | B2 | 12/2006 | Jonte | |
| 7,174,577 | B2 | 2/2007 | Jost et al. | |
| 7,174,579 | B1 | 2/2007 | Bauza | |
| 7,232,111 | B2 | 6/2007 | McDaniels et al. | |
| 7,278,624 | B2 | 10/2007 | Iott et al. | |
| 7,307,485 | B1 | 12/2007 | Snyder et al. | |
| 7,461,560 | B2 * | 12/2008 | Arms et al. | 73/786 |
| 7,537,023 | B2 | 5/2009 | Marty et al. | |
| 7,537,195 | B2 | 5/2009 | McDaniels et al. | |
| 7,690,395 | B2 | 4/2010 | Jonte et al. | |
| 7,766,026 | B2 | 8/2010 | Boey | |
| 7,784,481 | B2 | 8/2010 | Kunkel | |
| 8,040,142 | B1 * | 10/2011 | Bokma et al. | 324/658 |
| 8,042,202 | B2 * | 10/2011 | Parsons et al. | 4/623 |
| 2001/0011389 | A1 | 8/2001 | Philipps-Liebich et al. | |
| 2001/0011390 | A1 | 8/2001 | Humpert et al. | |
| 2001/0011558 | A1 | 8/2001 | Schumacher | |
| 2001/0011560 | A1 | 8/2001 | Pawelzik et al. | |
| 2001/0022352 | A1 | 9/2001 | Rudrich | |
| 2002/0007510 | A1 | 1/2002 | Mann | |
| 2002/0015024 | A1 | 2/2002 | Westerman et al. | |
| 2002/0113134 | A1 | 8/2002 | Laing et al. | |
| 2002/0117122 | A1 | 8/2002 | Lindner | |
| 2002/0148040 | A1 | 10/2002 | Mateina | |
| 2002/0175789 | A1 | 11/2002 | Pimouguet | |
| 2002/0179723 | A1 | 12/2002 | Wack et al. | |
| 2003/0041374 | A1 | 3/2003 | Franke | |
| 2003/0080194 | A1 | 5/2003 | O'Hara et al. | |
| 2003/0088338 | A1 | 5/2003 | Phillips et al. | |
| 2003/0089399 | A1 | 5/2003 | Acker | |
| 2003/0125842 | A1 | 7/2003 | Chang et al. | |
| 2003/0126993 | A1 | 7/2003 | Lassota et al. | |
| 2003/0185548 | A1 | 10/2003 | Novotny et al. | |
| 2003/0201018 | A1 | 10/2003 | Bush | |
| 2003/0213062 | A1 | 11/2003 | Honda et al. | |
| 2003/0234769 | A1 | 12/2003 | Cross et al. | |
| 2004/0011399 | A1 | 1/2004 | Segien, Jr. | |
| 2004/0041033 | A1 | 3/2004 | Kemp | |
| 2004/0041034 | A1 | 3/2004 | Kemp | |
| 2004/0041110 | A1 | 3/2004 | Kaneko | |
| 2004/0061685 | A1 | 4/2004 | Ostergard et al. | |
| 2004/0088786 | A1 | 5/2004 | Malek et al. | |
| 2004/0135010 | A1 | 7/2004 | Malek et al. | |
| 2004/0143898 | A1 | 7/2004 | Jost et al. | |
| 2004/0144866 | A1 | 7/2004 | Nelson et al. | |
| 2004/0149643 | A1 | 8/2004 | Vandenbelt et al. | |
| 2004/0155116 | A1 | 8/2004 | Wack et al. | |
| 2004/0206405 | A1 | 10/2004 | Smith et al. | |
| 2004/0212599 | A1 | 10/2004 | Cok et al. | |
| 2004/0262552 | A1 | 12/2004 | Lowe | |
| 2005/0001046 | A1 | 1/2005 | Laing | |
| 2005/0006402 | A1 | 1/2005 | Acker | |
| 2005/0022871 | A1 | 2/2005 | Acker | |
| 2005/0044625 | A1 | 3/2005 | Kommers | |
| 2005/0086958 | A1 | 4/2005 | Walsh | |
| 2005/0117912 | A1 | 6/2005 | Patterson et al. | |
| 2005/0121529 | A1 | 6/2005 | DeLangis | |
| 2005/0125083 | A1 | 6/2005 | Kiko | |
| 2005/0127313 | A1 | 6/2005 | Watson | |
| 2005/0146513 | A1 | 7/2005 | Hill et al. | |
| 2005/0150552 | A1 | 7/2005 | Forshey | |
| 2005/0150556 | A1 | 7/2005 | Jonte | |
| 2005/0150557 | A1 | 7/2005 | McDaniel et al. | |
| 2005/0151101 | A1 | 7/2005 | McDaniel et al. | |
| 2005/0194399 | A1 | 9/2005 | Proctor | |
| 2005/0199841 | A1 | 9/2005 | O'Maley | |
| 2005/0199843 | A1 | 9/2005 | Jost et al. | |
| 2005/0205818 | A1 | 9/2005 | Bayley et al. | |
| 2005/0253102 | A1 | 11/2005 | Boilen et al. | |
| 2005/0273218 | A1 | 12/2005 | Breed et al. | |
| 2006/0066991 | A1 | 3/2006 | Hirano et al. | |
| 2006/0101575 | A1 | 5/2006 | Louis | |
| 2006/0130907 | A1 | 6/2006 | Marty et al. | |
| 2006/0130908 | A1 | 6/2006 | Marty et al. | |
| 2006/0138246 | A1 | 6/2006 | Stowe et al. | |
| 2006/0145111 | A1 | 7/2006 | Lang et al. | |
| 2006/0153165 | A1 | 7/2006 | Beachy | |
| 2006/0186215 | A1 | 8/2006 | Logan | |
| 2006/0200903 | A1 | 9/2006 | Rodenbeck et al. | |
| 2006/0201558 | A1 | 9/2006 | Marty et al. | |
| 2006/0202142 | A1 | 9/2006 | Marty et al. | |
| 2006/0207019 | A1 | 9/2006 | Vincent | |
| 2006/0212016 | A1 | 9/2006 | Lavon et al. | |
| 2006/0214016 | A1 | 9/2006 | Erdely et al. | |
| 2006/0231638 | A1 | 10/2006 | Belz et al. | |
| 2006/0231782 | A1 | 10/2006 | Iott et al. | |
| 2006/0231788 | A1 | 10/2006 | Cheng | |
| 2006/0237674 | A1 | 10/2006 | Iott et al. | |
| 2006/0283511 | A1 | 12/2006 | Nelson | |
| 2007/0001018 | A1 | 1/2007 | Schmitt et al. | |
| 2007/0057215 | A1 | 3/2007 | Parsons et al. | |
| 2007/0069168 | A1 | 3/2007 | Jonte | |
| 2007/0069169 | A1 | 3/2007 | Lin | |
| 2007/0114073 | A1 | 5/2007 | Akel et al. | |
| 2007/0138421 | A1 | 6/2007 | Gibson et al. | |
| 2007/0156260 | A1 | 7/2007 | Rodenbeck et al. | |
| 2007/0157978 | A1 | 7/2007 | Jonte | |
| 2007/0187635 | A1 | 8/2007 | Jost | |
| 2007/0246267 | A1 | 10/2007 | Koottungal | |
| 2007/0246550 | A1 | 10/2007 | Rodenbeck et al. | |
| 2007/0246564 | A1 | 10/2007 | Rodenbeck et al. | |
| 2008/0078019 | A1 | 4/2008 | Allen et al. | |
| 2008/0099088 | A1 | 5/2008 | Boey | |
| 2008/0109956 | A1 | 5/2008 | Bayley et al. | |
| 2008/0178950 | A1 | 7/2008 | Marty et al. | |
| 2008/0271238 | A1 | 11/2008 | Reeder et al. | |
| 2008/0289098 | A1 | 11/2008 | Kunkel | |
| 2009/0039176 | A1 | 2/2009 | Davidson et al. | |
| 2009/0119832 | A1 | 5/2009 | Conroy | |
| 2009/0160659 | A1 | 6/2009 | Bailey | |
| 2009/0167580 | A1 * | 7/2009 | Hutchinson | 341/143 |
| 2009/0293192 | A1 | 12/2009 | Pons | |
| 2010/0012194 | A1 | 1/2010 | Jonte et al. | |
| 2010/0096017 | A1 | 4/2010 | Jonte et al. | |
| 2010/0170570 | A1 | 7/2010 | Rodenbeck et al. | |
| 2011/0063246 | A1 * | 3/2011 | Wei et al. | 345/174 |

FOREIGN PATENT DOCUMENTS

| | | | |
|---|---|---|---|
| DE | 04401637 | | 5/1998 |
| DE | 19815324 | | 11/2000 |
| EP | 0961067 | B1 | 12/1999 |
| EP | 1 134 895 | | 9/2001 |
| JP | 63111383 | | 5/1998 |
| JP | 200073426 | | 3/2000 |
| JP | 2003-20703 | A | 1/2003 |
| JP | 2003105817 | | 4/2003 |
| JP | 2003293411 | | 10/2003 |
| JP | 2004-92023 | | 3/2004 |
| JP | 2005-146551 | A | 6/2005 |
| KR | 10-1997-0700266 | | 1/1997 |
| KR | 2003-0077823 | | 10/2003 |
| KR | 20-0382786 | Y1 | 4/2005 |
| WO | WO 91/17377 | | 11/1991 |

| | | |
|---|---|---|
| WO | WO 96 14477 | 5/1996 |
| WO | WO 01/20204 | 3/2001 |
| WO | WO2004/094990 | 11/2004 |
| WO | WO 2005/057086 | 6/2005 |
| WO | WO 2006/098795 | 9/2006 |
| WO | WO 2006/136256 | 12/2006 |
| WO | WO 2007/059051 | 5/2007 |
| WO | WO 2007/124311 | 11/2007 |
| WO | WO 2007/124438 | 11/2007 |
| WO | WO 2008/088534 | 7/2008 |
| WO | WO 2008/094247 | 8/2008 |
| WO | WO 2008/094651 | 8/2008 |
| WO | WO 2008/118402 | 10/2008 |
| WO | WO 2009/075858 | 6/2009 |

OTHER PUBLICATIONS

Dallmer Manutronic brochure, "The First Electronic mixer-taps that your hands can orchestrate," Dallmer Handel GmbH, at least as early as Jan. 31, 2008, 12 pgs.
International Search Report and Written Opinion for PCT/US2007/025336, 5 pages.
International Search Report and Written Opinion for PCT/US2008/67116, 9 pages.
KWC AG, Kitchen Faucet 802285 Installation and Service Instructions, dated Jul. 2005, 8 pgs.
Philipp, Hal, "Tough Touch Screen," applicanceDESIGN, Feb. 2006.
Quantum Research Group, "E401 User Manual," 15 pgs.
Quantum Research Group, "Gorenje Puts QSlide™ Technology into Next-Generation Kitchen Hob," Feb. 8, 2006, http://www.qprox.com/news/gorenje.php, 3 pgs.
Quantum Research Group, "Qprox™ Capacitive Touch Applications," http://www.qprox.com/background/applications.php, 8 pgs.
Quantum Research Group, "QT401 QSlide™ Touch Slider IC," 2004, 16 pgs.
Quantum Research Group, "QT411-ISSG QSlide™ Touch Slider IC," 2004-2005, 12 pgs.
Sequine et al., Cypress Perform, "Application Notes AN2292," Oct. 31, 2005, 15 pgs.
Sequine et al., Cypress Perform, "Application Notes AN2233a," Apr. 14, 2005, 6 pgs.
Sloan® Optima® i.q. Electronic Hand Washing Faucet, Apr. 2004, 2 pgs.
Symmons, Ultra-Sense, Battery-Powered Faucets with PDS and Ultra-Sense AC Powered Faucets, © 1999-2004, 2 pgs.
Symmons, Ultra-Sense, Sensor Faucet with Position-Sensitive Detection, © 2001-2002, 2 pgs.
Symmons® Commercial Faucets: Reliability With a Sense of Style, 1 pg.
Symmons®, "Ultra-Sense® Battery-Powered, Sensor-Operated Lavatory Faucet S-6080 Series," Oct. 2002, 4 pgs.
Symmons®, "Ultra-Sense® Sensor Faucets with Position-Sensitive Detection," Aug. 2004, 4 pgs.
Technical Concepts International, Inc., Capri AutoFaucet® with Surround Sensor™ Technology, 500556, 500576, 500577, (undated), 1 pg.
Technical Concepts, AutoFaucet® with "Surround Sensor" Technology, Oct. 2005, 4 pgs.
Toto® Products, "Self-Generating EcoPower System Sensor Faucet, Standard Spout," Specification Sheet, Nov. 2002, 2 pgs.
Various Products (available at least before Apr. 20, 2006), 5 pgs.
Villeroy & Boch "Magic Faucet," 2 pgs.
Villeroy & Boch web pages, "Magic Basin," 2 pgs., downloaded from http://www.villeroy-boch.com on Dec. 27, 2006.
Zurn® Plumbing Products Group, "AquaSense® Sensor Faucet," Jun. 9, 2004, 2 pgs.
Zurn® Plumbing Products Group, "AquaSense® Z6903 Series", Installation, Operation, Maintenance and Parts Manual, Aug. 2001, 5 pgs.
International Search Report and Written Opinion for PCT/US2008/003829, mailed Jun. 18, 2008, 9 pages.

* cited by examiner

CAPACITIVE TOUCH SENSOR

CROSS-REFERENCE TO RELATED APPLICATIONS

This application is a U.S. National Phase Application of PCT International Application No. PCT/US2008/003829, filed on Mar. 24, 2008, which claims the benefit of U.S. Provisional Application No. 60/920,420, filed on Mar. 28, 2007, the disclosures of which are expressly incorporated by reference herein.

BACKGROUND AND SUMMARY OF THE INVENTION

The present invention generally relates generally to the field of automatic faucets. More particularly, the present invention relates to an improved capacitive touch controller for automatic faucets.

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent-vandalism.

One early version of an automatic faucet was simply a spring-controlled faucet, which returned to the "off" position either immediately, or shortly after, the handle was released. The former were unsatisfactory because a user could only wash one hand at a time, while the latter proved to be mechanically unreliable.

One solution was the hands-free faucet. These faucets typically employ an IR or capacitive proximity detector and an electric power source to activate water flow without the need for a handle. Although hands-free faucets have many advantages, some people prefer to control the start and stop of water directly, depending on how they use the faucet. For example, if the user wishes to fill the basin with water to wash something, the hands-free faucet could be frustrating, since it would require the user to keep a hand continuously in the detection zone of the proximity sensors.

Thus, for many applications touch control is preferable to hands-free control. Touch control provides a useful supplement to manual control. Typically, faucets use the same manual handle (or handles) to turn the water flow off and on and to adjust the rate of flow and water temperature. Touch control therefore provides both a way to turn the water off an on with just a tap, as well as a way to do so without having to readjust the rate of flow and water temperature each time.

Since the purpose of a touch-control is to provide the simplest possible way for a user to activate and deactivate the flow of water, the location of the touch control is an important aspect of its utility. The easier and more accessible the touch control, the more effort is saved with each use, making it more likely that the user will take advantage of it, thereby reducing unnecessary water use. Since the spout of the faucet is closest to the position of the user's hands during most times while the sink is in use, the spout is an ideal location for the touch control. However, locating the capacitive touch sensor on the spout may cause inaccuracies due to the flow of highly conductive water through the spout. The handle of a faucet is another good location for a touch sensor, because the user naturally makes contact with the handle of the faucet during operation.

The present invention provides an improved capacitive touch sensor which is sensitive to a user's touch without being sensitive to resistive impedance due to water flowing adjacent an electrode of the sensor. Therefore, the capacitive touch sensor can detect a user's touch quickly while using minimal power.

According to one illustrated embodiment of the present invention, a fluid delivery apparatus comprises a spout, a fluid supply conduit supported by the spout, a valve assembly to supply fluid through the fluid supply conduit, a capacitive touch sensor including an electrode, and a pulse generator. The apparatus also includes a DC filter coupled to an output of the pulse generator and to the electrode, a rectifier having an input coupled to an output of the DC filter, and a controller coupled to an output of the rectifier. The controller is also coupled to the valve assembly. The controller is configured to detect a user touching the electrode based on an output signal from the rectifier and configured to control flow of fluid through the fluid supply conduit.

In one illustrated embodiment, a proximity sensor is located adjacent the spout. The proximity sensor is coupled to the controller to provide a hands free supply of fluid through the fluid supply conduit in response to detecting a user's presence with the proximity sensor. The controller switches back and forth between a manual mode and a hands free mode in response the capacitive touch sensor detecting the user touching the electrode.

In another illustrated embodiment, a handle is provided for manually controlling the valve assembly to provide fluid flow through the fluid supply conduit. The controller switches back and forth between a manual mode and an automatic mode in response to the capacitive touch sensor detecting the user touching the electrode.

It is understood that the capacitive sensing techniques described herein have applications other than just the fluid delivery devices illustrated herein. According to another illustrated embodiment of the present invention, a capacitive touch sensor comprises an electrode, a pulse generator, a DC filter coupled to the pulse generator and the electrode, a rectifier having an input coupled to an output of the DC filter, and a control circuit coupled to an output of the rectifier. The control circuit is configured to detect a user touching the electrode.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

For the purposes of promoting an understanding of the principles of the invention, reference will now be made to certain illustrated embodiments and specific language will be used to describe the same. It will nevertheless be understood that no limitation of the scope of the invention is thereby intended. Such alterations and further modifications of the invention, and such further applications of the principles of the invention as described herein as would normally occur to one skilled in the art to which the invention pertains, are contemplated, and desired to be protected.

Figure 1:
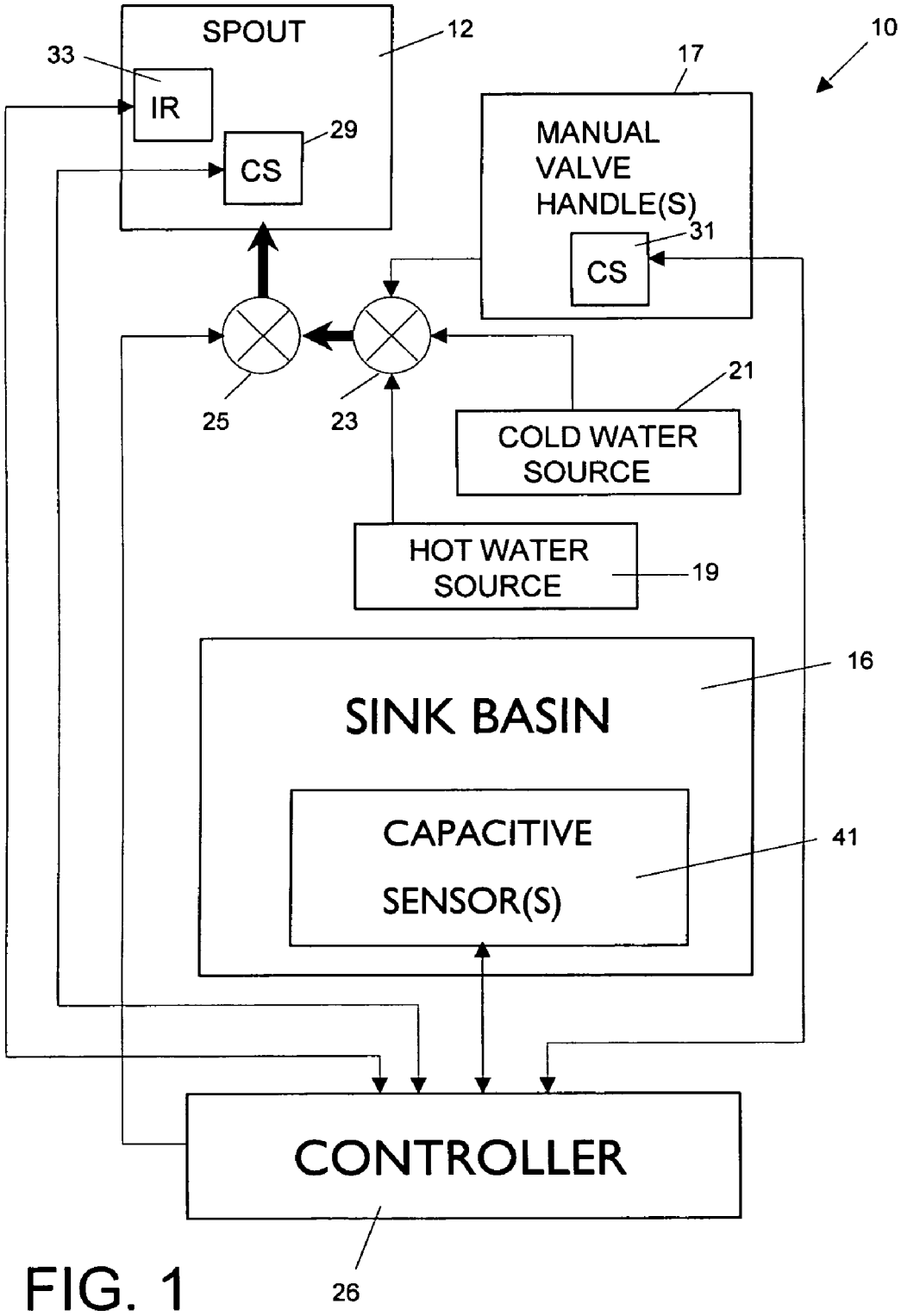
FIG. 1 is a block diagram illustrating an improved capacitive sensing system of the present invention.

FIG. 1 is a block diagram illustrating one embodiment of a sensing faucet system 10 of the present invention. The system 10 includes a sink basin 16, a spout 12 for delivering water into the basin 16 and at least one manual valve handle 17 for controlling the flow of water through the spout 12 in a manual mode. A hot water source 19 and cold water source 21 are coupled to a valve body assembly 23. In one illustrated embodiment, separate manual valve handles 17 are provided for the hot and cold water sources 19, 21. In other embodiments, such as a kitchen embodiment, a single manual valve handle 17 is used for both hot and cold water delivery. In such kitchen embodiment, the manual valve handle 17 and spout 12 are typically coupled to the basin 16 through a single hole mount. An output of valve body assembly 23 is coupled to an actuator driven valve 25 which is controlled electronically by input signals from a controller 26. In an illustrative embodiment, actuator driven valve 25 is a magnetically latching pilot-controlled solenoid valve.

In an alternative embodiment, the hot water source 19 and cold water source 21 are connected directly to actuator driven valve 25 to provide a fully automatic faucet without any manual controls. In yet another embodiment, the controller 26 controls an electronic proportioning valve (not shown) to supply water for the spout 12 from hot and cold water sources 19, 21.

Because the actuator driven valve 25 is controlled electronically by controller 26, flow of water can be controlled using outputs from sensors as discussed herein. As shown in FIG. 1, when the actuator driven valve 25 is open, the faucet system may be operated in a conventional manner, i.e., in a manual control mode through operation of the handle(s) 17 and the manual valve member of valve body assembly 23. Conversely, when the manually controlled valve body assembly 23 is set to select a water temperature and flow rate, the actuator driven valve 25 can be touch controlled, or activated by proximity sensors when an object (such as a user's hands) are within a detection zone to toggle water flow on and off.

Spout 12 may have capacitive touch sensors 29 and/or an IR sensor 33 connected to controller 26. In addition, the manual valve handle(s) 17 may also have a capacitive touch sensor 31 mounted thereon which are electrically coupled to controller 26.

In illustrative embodiments of the present invention, capacitive sensors 41 may also be coupled to the sink basin 16 in various orientations as discussed below. In illustrated embodiments of the present invention, capacitive sensors 41 are placed on an exterior wall of the basin 16 or embedded into the wall of the basin 16. Output signals from the capacitive sensors 41 are also coupled to controller 26. The output signals from capacitive sensors 41 therefore may be used to control actuator driven valve 25 which thereby controls flow of water to the spout 12 from the hot and cold water sources 19 and 21.

Each sensor 29, 31, 41 may include an electrode which is connected to a capacitive sensor such as a timer or other suitable sensor as discussed herein. By sensing capacitance changes with capacitive sensors 29, 31, 41 controller 26 can make logical decisions to control different modes of operation of system 10 such as changing between a manual mode of operation and a hands free mode of operation as described in U.S. application Ser. No. 11/641,574; U.S. application Ser. No. 10/755,581; U.S. application Ser. No. 11/325,128; U.S. Provisional Application Ser. No. 60/662,107; U.S. Provisional Application Ser. No. 60/898,525; and U.S. Provisional Application Ser. No. 60/898,524, the disclosures of which are all expressly incorporated herein by reference.

The amount of fluid from hot water source 19 and cold water source 21 is determined based on one or more user inputs, such as desired fluid temperature, desired fluid flow rate, desired fluid volume, various task based inputs (such as vegetable washing, filling pots or glasses, rinsing plates, and/or washing hands), various recognized presentments (such as vegetables to wash, plates to wash, hands to wash, or other suitable presentments), and/or combinations thereof. As discussed above, the system 10 may also include electronically controlled mixing valve which is in fluid communication with both hot water source 19 and cold water source 21. Exemplary electronically controlled mixing valves are described in U.S. patent application Ser. No. 11/109,281 and U.S. Provisional Patent Application Ser. No. 60/758,373, filed Jan. 12, 2006, the disclosures of which are expressly incorporated by reference herein.

Spout 12 is illustratively formed from traditional metallic materials, such as zinc or brass. In other embodiments, spout 12 may be formed from a non-conductive material as described in U.S. Provisional Application Ser. No. 60/898,524, the disclosure of which is expressly incorporated herein by reference. Spout 12 may also have selective metal plating over the non-conductive material.

Figure 2:
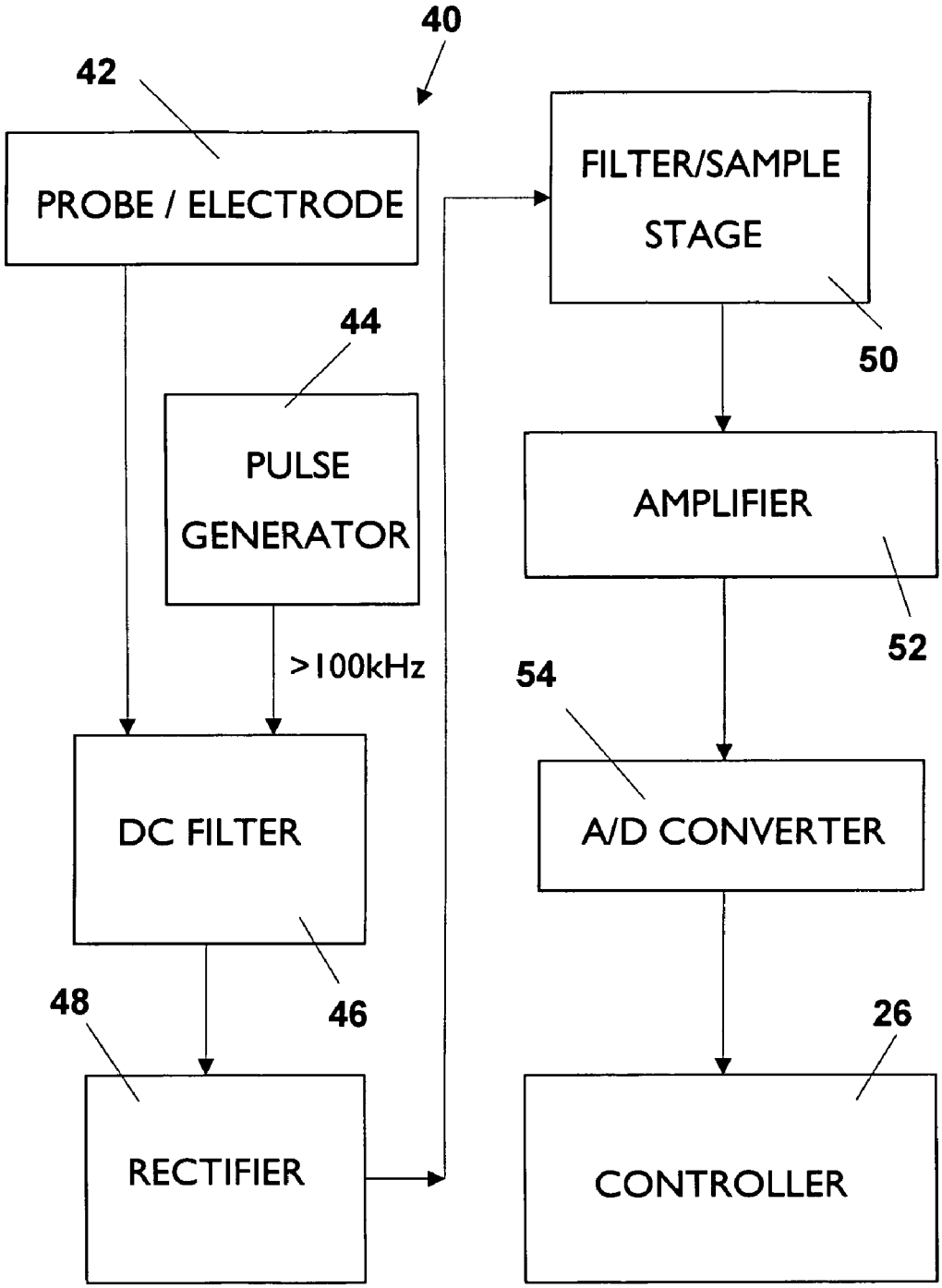
FIG. 2 is a block diagram of an illustrated embodiment of an improved capacitive touch sensor of the present invention.

FIG. 2 illustrates a capacitive sensor system which is substantially immune to a wide range of water conductivity levels typically seen in plumbing applications. Fluid flowing through the spout 12, such as water, can vary greatly in different installations and locations across the world and is sometimes highly conductive. In most installations, the water is ultimately connected to earth ground which can severely attenuate or reduce performance of capacitive touch and proximity sensors when the sensor's electrode is coupled to the water stream either directly or through a capacitive coupling.

An illustrated embodiment of the present invention reduces the effects of the highly conductive water on system operation. In this embodiment, the capacitive sensor is driven with a relatively high frequency DC signal which is fed into an RC circuit and then tuned so that the sensor is affected by a typical model of the human body. In the illustrative embodiment, the frequency of the high frequency DC signal is illustratively greater than or equal to 100 kHz. The high frequency DC signal has its DC component filtered, thereby providing an AC signal. The AC signal is then full wave rectified, low pass filtered, and sampled before or after an optional amplifier stage.

Due to the tuned sensitivity of this sensor circuitry, the amplitude of the signal is attenuated by physical touch of a human body. This reduction of amplitude causes a sampled DC signal to be less which allows the circuitry to detect the touch. Based on the nature of the transfer function of the system, the resistive component added by conductive water is virtually ignored compared to the capacitive element of the human body. This allows a wide range of conductivities to be present, yet still provide a consistent capacitive touch sensor output in most applications. Automatic calibration techniques may be used to further adapt the capacitive sensor system for intended applications.

As illustrated in FIG. 2, a capacitive sensor system 40 according to an illustrated embodiment includes a sensor probe or electrode 42 which may be coupled, for example, to the spout 12, handle 17 or sink basin 16 as discussed herein.

The electrode 42 may turn a portion of the metallic spout 12 or handle 17 (or the entire metallic spout 12 or handle 17) into a capacitive touch sensor probe. The output of probe 42 is connected to a DC filter 46.

A pulse generator 44 is illustratively configured to provide an output signal of greater than or equal to about 100 kHz. In the illustrated embodiment, a low power ICM7555 timer chip may be used to provide the pulse generator 44. Pulse generator illustratively provides a square wave output signal. It is understood that the pulse generator 44 may also provide, for example, a sine wave, a triangle wave, or other suitable pulse wave. Pulse generator 44 is also coupled to the DC filter 46.

DC filter 46 is illustratively provided by a series of resistors and capacitors configured to filter the DC component of the output signal. The DC filter 46 reacts to changes in capacitance adjacent probe 42 (due to human touch) and ignores the effect of resistance impedance (due to, for example, water) connected to earth ground.

The output of the DC filter 46 is coupled to a rectifier 48. Illustratively, rectifier 48 is a full wave rectifier, although a half wave rectifier may also be used. Rectifier 48 is illustratively provided using a standard operational amplifier specified to swing from "rail-to-rail" and which has a sufficient bandwidth and slew rate. The slew rate is the device's ability to output a certain amount of voltage within a predetermined fixed period of time.

A filter/sample stage 50 is coupled to the rectifier 48 to allow for minimal low pass filtering and to create a purely DC voltage which can be read by an analog-to-digital converter 54 which is found on most microcontrollers. Depending upon the performance of the specific analog-to-digital converter 54 used, an optional gain or amplifier stage 52 may be added to increase the amplitude of the signal from filter/sample stage 50.

The output of amplifier 52 is coupled to A/D converter 54. The output of the A/D converter 54 is coupled to a controller 26. When a user's hand touches the electrode 42, the capacitance to earth ground detected by the capacitive sensors increases. Controller 26 receives the output signal and determines whether to turn on or off the water based on changes in capacitance to earth ground.

Figure 3:
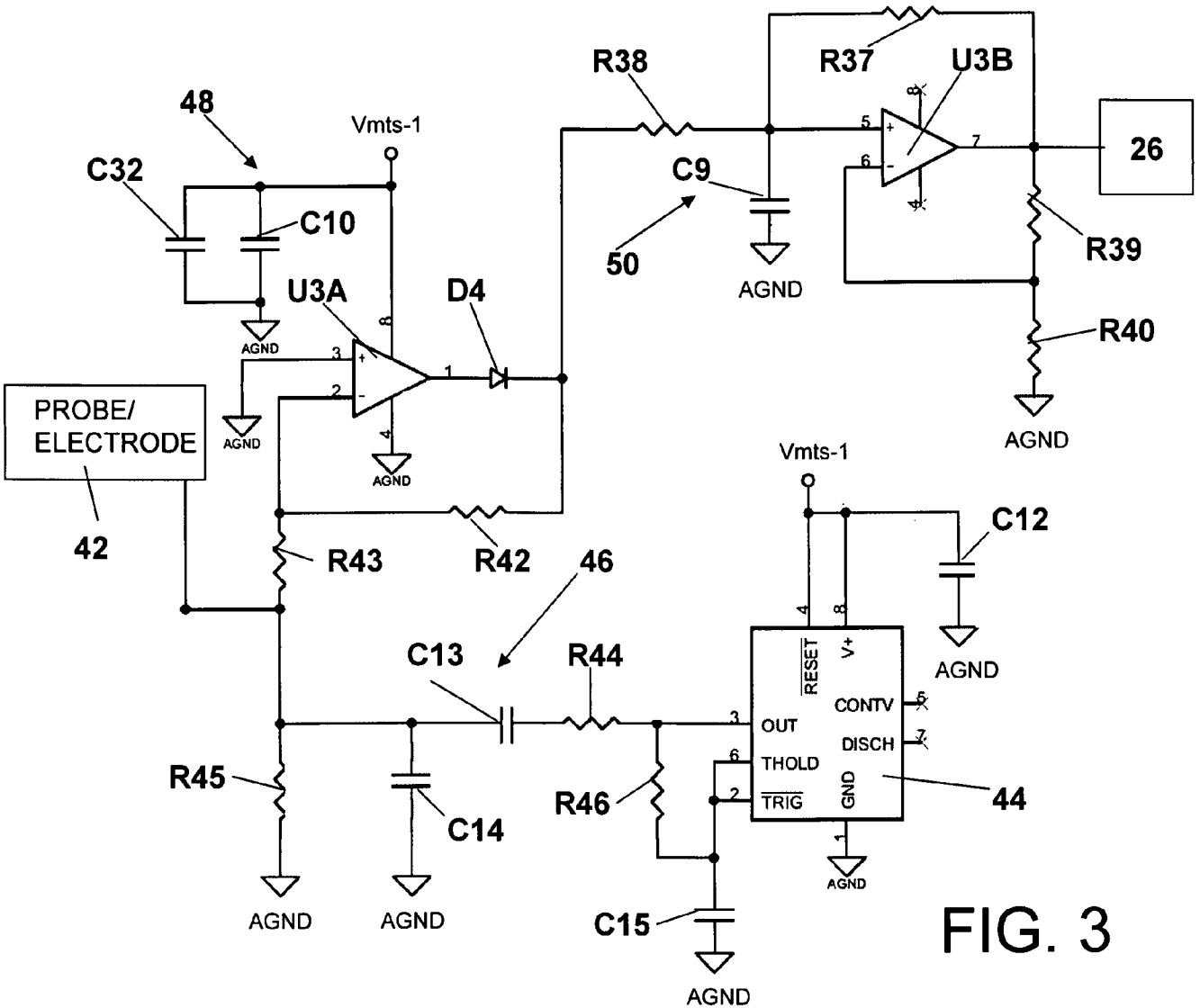
FIG. 3 is an electrical schematic of one illustrated embodiment of the present invention.

FIG. 3 is an illustrated schematic of one embodiment of the present invention. The rectifier 48 illustratively includes components (U3A, R42, R43, D4, and C10, and C32.) The Filter/Sample stage 50 illustratively includes components R38 and C9. The Filter/Sample stage 50 is illustratively a low pass filter with cutoff frequency defined by $f_c=\frac{1}{2}*\pi*R*C)=1.6$ kHz. This frequency should be adjusted depending on the frequency of pulse generator 44. Although pulse generator 44 is illustrated as a separate ICM7555 timer chip, it is understood that the DC filter 46 may be driven by any suitable signal generator, crystal based oscillator, or with a pulse generator provided as part of the controller 26. C13, C14, R44 and R45 make up the DC Filter/Amplitude Divider 46 for sensing a touch.

In the illustrated embodiment, the circuit ground is connected to earth ground. Since the change in capacitance that the probe 42 is trying to detect is referenced to earth ground, the circuit's reference is preferably also be tied to earth ground, however, a "virtual ground" may be used in its place. This connection creates a large signal-to-noise ratio which improves the sensor's ability to detect touch quickly, while using minimal power. With a small signal-to-noise ratio, much more processing would be necessary, thereby negating the benefit of low power and fast response provided with the illustrated embodiment.

As described herein the capacitive touch sensor may be used to control faucets in a manner similar to the controls shown in U.S. Pat. No. 6,962,168; U.S. Pat. No. 7,150,293; or U.S. application Ser. No. 11/641,574, the disclosures of which are all expressly incorporated herein by reference. It is understood that the capacitive touch sensor is not limited to use in faucets or fluid delivery devices and may be used in other sensing applications.

Although the invention has been described in detail with reference to certain preferred embodiments, variations and modifications exist within the spirit and scope of the invention as described and defined in the following claims.

The invention claimed is:

1. A fluid delivery apparatus comprising:

a spout;

a fluid supply conduit supported by the spout;

a valve assembly to supply fluid through the fluid supply conduit;

a capacitive touch sensor including an electrode, a pulse generator, a DC filter coupled to an output of the pulse generator and the electrode and configured to filter a DC component of the combined signals from the electrode and the pulse generator to provide an AC output signal, a rectifier having an input coupled to an output of the DC filter to provide a DC output signal; and a controller coupled to an output of the rectifier, the controller also being coupled to the valve assembly, the controller being configured to detect a user touching the electrode based on the DC output signal from the rectifier and configured to control flow of fluid through the fluid supply conduit.

2. The apparatus of claim 1, wherein the pulse generator is one of a square wave generator, a sine wave generator, and a triangle wave generator.

3. The apparatus of claim 1, wherein the pulse generator generates an output signal having a frequency of about 100 kHz.

4. The apparatus of claim 1, wherein the pulse generator generates an output signal having a frequency greater than 100 kHz.

5. The apparatus of claim 1, wherein the DC filter includes a series of resistors and capacitors configured to filter a DC component of an output signal from the pulse generator.

6. The apparatus of claim 1, wherein the DC filter reacts to changes in capacitive due to the user touching the electrode and ignores an effect of resistance impedance due to water flowing through the fluid supply conduit.

7. The apparatus of claim 1, wherein the rectifier includes an operational amplifier specified to swing from rail-to-rail.

8. The apparatus of claim 1, further comprising means for coupling the capacitive touch sensor to earth ground.

9. The apparatus of claim 1, wherein the electrode is coupled to the spout.

10. The apparatus of claim 9, wherein the spout is formed from a conductive material.

11. The apparatus of claim 1, wherein the controller detects a change in a dielectric constant adjacent the electrode.

12. The apparatus of claim 1, wherein the controller controls the valve assembly to adjust fluid flow through the fluid supply conduit based on capacitance changes detected by the capacitive touch sensor.

13. The apparatus of claim 1, wherein the electrode is embedded in a non-conductive material forming the spout.

14. The apparatus of claim 1, wherein the controller is configured to actuate the valve assembly automatically and supply fluid through the fluid supply conduit in response to detecting a user touching the electrode.

15. The apparatus of claim 1, wherein the fluid supply conduit is separate from the spout.

16. The apparatus of claim 1, wherein the electrode is coupled to an outer surface of the spout.

17. The apparatus of claim 1, further comprising a proximity sensor located adjacent the spout, the proximity sensor being coupled to the controller to provide a hands free supply of fluid through the fluid supply conduit in response to detecting a user's presence with the proximity sensor, and the controller switching back and forth between a manual mode and a hands free mode in response to the capacitive touch sensor detecting the user touching the electrode.

18. The apparatus of claim 1, wherein the electrode is coupled to a handle for controlling fluid flow.

19. The apparatus of claim 1, further comprising a handle for manually controlling the valve assembly to provide fluid flow through the fluid supply conduit, the controller switching between back and forth a manual mode and an automatic mode in response to the capacitive touch sensor detecting the user touching the electrode.

20. The apparatus of claim 1, further comprising a filter stage having an input coupled to the output of the rectifier and an output coupled to the controller.

21. The apparatus of claim 20, further comprising an analog-to-digital converter having an input coupled to the output of the filter stage and an output coupled to the controller.

22. The apparatus of claim 21, further comprising an amplifier coupled between the output of the filter stage and the input of the analog-to-digital converter.

23. The apparatus of claim 20, wherein the filter stage comprises a low pass filter which provides a DC voltage supply to the analog-to-digital converter.

24. The apparatus of claim 1, wherein the rectifier is a full wave rectifier.

25. A capacitive touch sensor comprising:

an electrode;

a pulse generator;

a DC filter coupled to an output of the pulse generator and to the electrode, the DC filter being configured to filter a DC component of a combined signal from the electrode and the pulse generator to provide an AC output signal;

a rectifier having an input coupled to an output of the DC filter to rectify the AC output signal and provide a DC output signal; and a control circuit coupled to an output of the rectifier, the control circuit being configured to detect a user touching the electrode based on changes in the DC output signal.

26. The sensor of claim 25, wherein the control circuit detects a user touching the electrode based on changes in a DC voltage level of an output signal from the rectifier.

27. The sensor of claim 25, wherein the pulse generator is one of a square wave generator, a sine wave generator, and a triangle wave generator.

28. The sensor of claim 25, wherein the pulse generator generates an output signal having a frequency of about 100 kHz.

29. The sensor of claim 25, wherein the pulse generator generates an output signal having a frequency greater than 100 kHz.

30. The sensor of claim 25, wherein the DC filter includes a series of resistors and capacitors configured to filter the DC component of the combined signal from the pulse generator and the electrode.

31. The sensor of claim 25, wherein the DC filter reacts to changes in capacitive due to the user touching the electrode and ignores an effect of resistance impedance.

32. The sensor of claim 25, wherein the rectifier includes an operational amplifier specified to swing from rail-to-rail.

33. The sensor of claim 25, further comprising means for coupling the capacitive touch sensor to earth ground.

34. The sensor of claim 25, wherein the controller detects a change in a dielectric constant adjacent the electrode.

35. The sensor of claim 25, further comprising a filter stage having an input coupled to the output of the rectifier and an output coupled to the controller.

36. The sensor of claim 35, further comprising an analog-to-digital converter having an input coupled to the output of the filter stage and an output coupled to the controller.

37. The sensor of claim 36, further comprising an amplifier coupled between the output of the filter/sample stage and the input of the analog-to-digital converter.

38. The sensor of claim 35, wherein the filter stage comprises a low pass filter which provides a DC voltage supply to the analog-to-digital converter.

39. The sensor of claim 25, wherein the rectifier is a full wave rectifier.

* * * * *